US005611362A

United States Patent [19]

Duncan et al.

[11] Patent Number: 5,611,362

[45] Date of Patent: Mar. 18, 1997

[54] MIRRORED COSMETIC CONTAINER

[76] Inventors: Christina M. Duncan, P.O. Box 595217, Dallas, Tex. 75359; Marie B. Duncan, 7148 E. Mockingbird La., Dallas, Tex. 75214

[21] Appl. No.: 393,811

[22] Filed: Feb. 24, 1995

[51] Int. Cl.[6] ..... A45D 42/02

[52] U.S. Cl. ..... 132/301; 132/305

[58] Field of Search ..... 132/301, 304, 132/305, 315, 316, 302, 303, 306, 296

[56] References Cited

U.S. PATENT DOCUMENTS

| | | | |
|---|---|---|---|
| D. 331,818 | 12/1992 | Holahan et al. | D28/82 |
| 1,229,285 | 6/1917 | Kendall | 132/301 X |
| 1,512,005 | 10/1924 | Wright | 132/301 |
| 1,525,665 | 2/1925 | Slover et al. | 132/296 |
| 1,989,155 | 1/1935 | Rosenberg | 132/305 |
| 2,421,646 | 6/1947 | Pepin | 132/305 |
| 3,949,767 | 4/1976 | Rose | 132/301 |
| 3,996,947 | 12/1976 | Szpur et al. | 132/316 |

*Primary Examiner*—Todd E. Manahan

[57] ABSTRACT

A cosmetic container comprising a top cover and a base or bottom cover hinged together to form a closable cosmetic compartment. The interior of the top cover includes a magnifying mirror secured therein and the outside surface of the bottom cover has a plain mirror secured thereto and facing outwardly therefrom.

1 Claim, 1 Drawing Sheet

MIRRORED COSMETIC CONTAINER

BACKGROUND OF THE INVENTION

1. Field of the Invention

The field of invention relates to a cosmetic container structure, and more particularly to a new and improved mirrored cosmetic container wherein the elements of same are arranged such that a magnifying mirror is employed inside the cover to aid individuals during the application of cosmetics who have a need or desire for magnification.

2. Description of the Prior Art

Cosmetic containers of various types have been utilized throughout the prior art to provide for the directing of cosmetic products relative to a holder structure such as is exemplified in U.S. Pat. No. 1,229,285(Kendall).

Kendall sets forth a cosmetic container having a mirror mounted on the top cover and also sets forth that the bottom cover may contain a second mirror on the outside. However, Kendall does not suggest the employment of distinctly different types of mirrors.

Kendall does set forth a cosmetic compact consisting of a top and bottom portion, with the top fitting the bottom when closed so as not to allow spillage of the contents of the compact, with the top hinged to the bottom. This compact may contain two mirrors, one secured to the inside of the top portion of the compact with its reflective surface facing the contents when the compact is closed, and the other secured by a frame outside the cosmetic compartment with its reflective surface facing outwardly.

Accordingly, it may be appreciated that there continues to be a need for a new and improved mirrored cosmetic container as set forth by the instant invention that addresses both the problems of ease of use as well as effectiveness in construction, and in this respect the present invention substantially fulfills this need.

SUMMARY OF THE INVENTION

In view of the foregoing disadvantages inherent in the known types of cosmetic container apparatus now present in the prior art, the present invention provides a mirrored cosmetic container wherein the elements of the same are arranged such that a magnifying mirror is employed in the top cover to permit visual enlargement of the features of the face for various purposes including the more precise application of cosmetics, for users who prefer magnification or who require magnification because of vision impairment. As such, the general purpose of the present invention, which will be described subsequently in greater detail, is to provide a new and improved mirrored cosmetic container which has all the advantages of the prior art and none of the disadvantages.

The prior art (Kendall) does set forth a cosmetic container that may contain a mirror in two places stating that a mirror can be placed in either or both locations. This differs from the instant invention in that in same there must be mirrors in both locations for the improvement as follows:

(1) The mirror on the inside lid is to be a magnifying mirror. This is a departure from the prior art in that the prior art does not mention two distinctly different mirrors, or the benefit of having this configuration, and there is no reason to have identical mirrors in two locations in one compact because of the relative ease in viewing either mirror. In the instant compact, the mirror on the top will be a magnifying mirror, which is important because it will be situated closest to the cosmetics housed in the lower portion of the compact and will aid the user in applying cosmetics; and (2) The mirror outside the cosmetic compartment facing outwardly is to be a plain mirror because that mirror will be used for quick checks of the overall face once makeup application is complete, the puff or makeup applicator has been replaced in the compact and the compact is closed. At this point there is no concern that the cosmetics or applicator will fall out, and the plain mirror can then be used to check not only the face and hair in front but also the hair and clothing in back in conjunction with public mirrors.

To attain this, the present invention is directed to a cosmetic assist kit that provides for the use of a magnifying mirror for the assistance of persons who either are not normally sighted or who prefer magnification. This magnifying mirror is contained in the top cover of the two component covers hinged together with the addition of a plain mirror on the bottom surface of the bottom cover.

This invention resides not in any one of these specific features per se, but rather in this particular combination of the two distinctly different mirrors herein disclosed and claimed, and it is distinguished from the prior art in this particular combination.

It is therefore an object of the present invention to provide a new and improved mirrored cosmetic container that has all the advantages of the prior art cosmetic containers and none of the disadvantages.

It is another object of the present invention to provide a new and improved mirrored cosmetic container that may be easily and efficiently manufactured and marketed.

There has thus been outlined, rather broadly, the more important features of the invention in order that the detailed description thereof that follows may be better understood, and which will form the subject matter of the claims appended hereto.

BRIEF DESCRIPTION OF THE DRAWING

The invention will be better understood and the benefits will become more apparent when consideration is given to the following detailed description thereof, such description making reference to the annexed drawing wherein.

DESCRIPTION OF THE PREFERRED EMBODIMENTS

Figure 1:
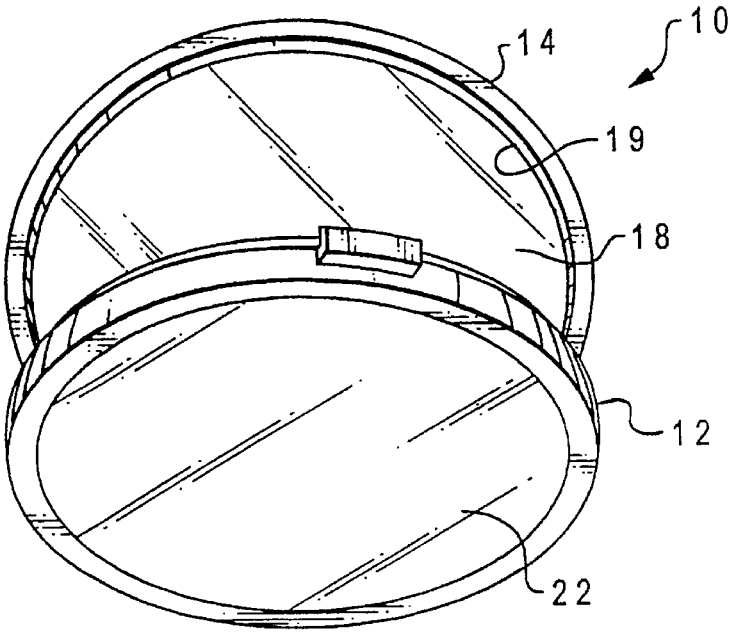
FIG. 1 is a perspective view of a cosmetic container in accordance with this invention showing the top cover containing the magnifying mirror and the bottom cover containing the plain mirror on the bottom surface of the cover.
Figure 2:
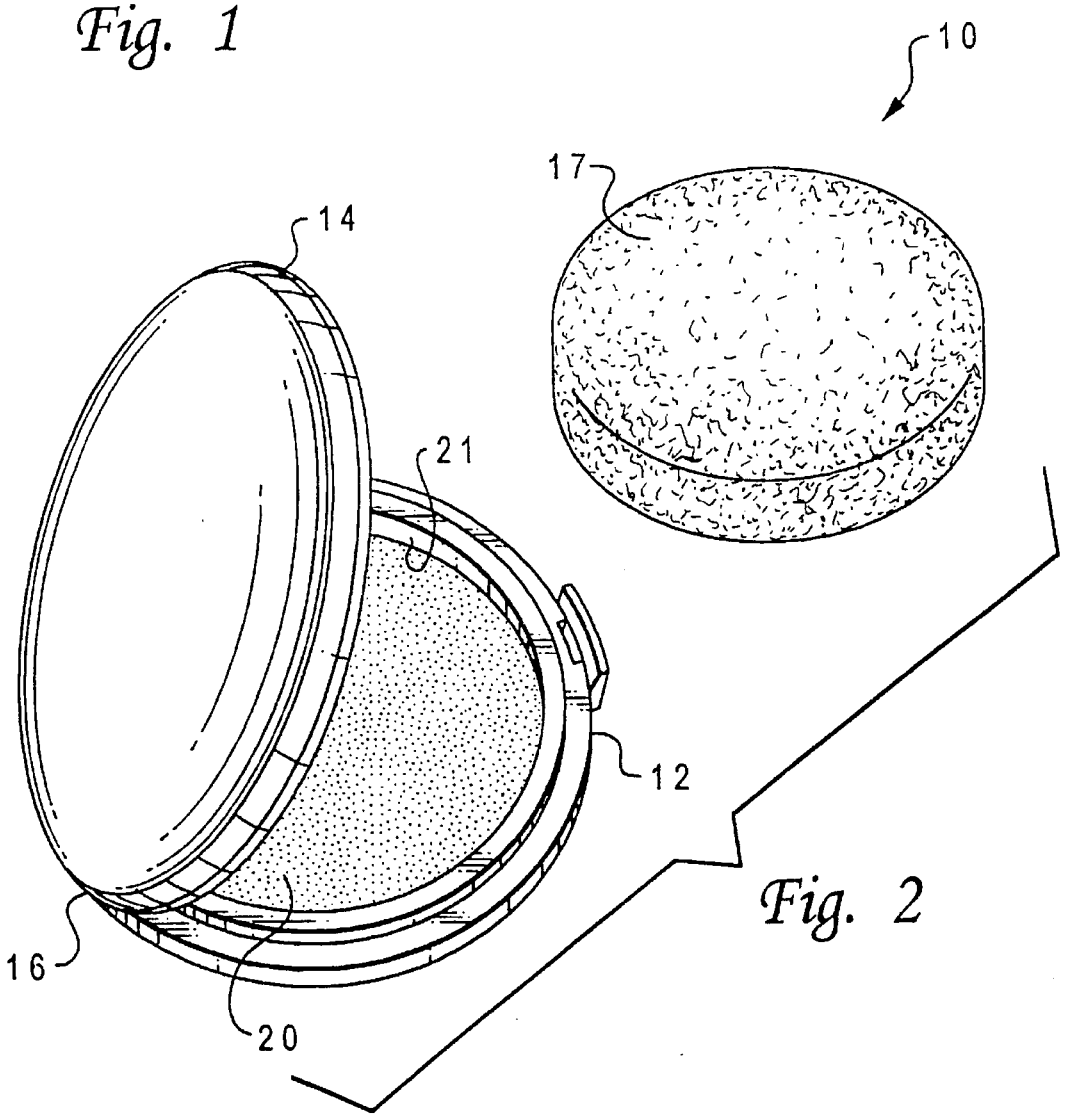
FIG. 2 is a perspective view showing the top cover of the container in open position and showing the container with a powder puff.

Referring to the drawing, a self-contained cosmetic or eye make-up kit or container 10 constructed according to this invention is illustrated as including a base(or bottom cover) 12 and a hinged lid or top cover 14. The cover 14 and base 12 are held together by a hinge 16. A magnifying mirror 18 is secured to the interior 19 of the top cover 14 and facing a cosmetic compartment 21 in the bottom cover or base 12. A second mirror 22 is secured to the outside of the bottom cover 12, as shown in FIG. 1 and faces outwardly and is distinctly different from the magnifying mirror in that mirror 22 comprises a plain mirror.

The parts of this invention including the base and cover may be constructed of impact-resistant plastic or metal and when the parts are folded together they provide a package that may be easily carried in a lady's handbag. The disclosed invention constitutes a specific improvement over the prior art by meeting the needs of women away from home who have become accustomed to using magnifying mirrors at home for the application of their makeup. Magnifying mirrors for many such women have become not just a convenience but a necessity, and that woman who must then apply her makeup away from home using only a plain mirror feels handicapped. Whatever one's reason tier purchasing a magnifying mirror for makeup application, whether to sharpen declining vision, to meet the demands of a particular profession requiring more precise application of makeup (for models, news anchors. etc.), or because of simple preference, the instant invention combines all the components needed away from home in one convenient package.

The instant invention is a further improvement over the prior art in that it combines two objects women frequently carp in their purses; namely, cosmetics and a hand-held, double-sided purse mirror. Using what is commercially available, a woman must get her cosmetic product in hand, apply the cosmetic to the applicator 17, set the cosmetic aside, and pick up the magnifying mirror for application. By combining cosmetics and both a magnifying and plain mirror into one product, the invention means one less article to carry, and less conspicuous application of makeup in public.

The instant invention is a further improvement over products, previously employed, in that the magnifying mirror 18 is logically positioned next to the cosmetics 20 where it is needed for more precise application of the makeup.

The disclosed invention is a further improvement over products commercially available in that the plain mirror 22 has been conveniently repositioned to be used much like a simple purse mirror. The plain mirror has been moved from inside the top cover 14 (in order to accommodate the magnifying mirror 18) to outside the cosmetic compartment 21, facing outwardly. This shift in position will enable women to make quick checks of the face, hair and clothing without the need to open the cosmetic portion of the compact and risk spillage. If a quick check reveals the need for more careful inspection, a magnifying mirror is already in hand. The plain mirror also provides a quick and convenient tool for checking the back of the hair and clothing when used in conjunction with mirrors provided in public places.

With respect to the above description then, it is to be realized that the optimum dimensional relationship for the parts of the invention, to include variations in size, materials, shape, form, function and manner of operation, assembly and use, is deemed readily apparent and obvious to one skilled in the art, and all equivalent relationships to those illustrated in the drawing and described in the specification are intended to be encompassed by the present invention.

Further, since numerous modifications and changes will readily occur to those skilled in the art, it is not desired to limit the instant invention to the exact construction and operation shown and described herein, and accordingly, all suitable modifications and equivalents will fall within the scope of the invention. For illustrative purposes one such modification would be an optional cover placed over the bottom mirror to avoid scratches, if this cosmetic device were subject to serve use such as hooked to a person's belt and used outdoors to protect the bottom plain mirror.

What is claimed as being new and desired to be protected by Letters Patent of the United States is as follows:

1. A hand held cosmetic container having a top cover and a bottom cover which are hinged together for movement between open and closed positions of said cosmetic container, said bottom cover defining a cosmetic compartment for containing cosmetics, said top cover including a magnifying mirror secured to an interior portion of said top cover and facing said bottom cover in a closed position of said cosmetic container, said magnifying mirror being viewable by a person using said cosmetic container while held in a person's hand in an open position of said cosmetic container, and a plain mirror secured to an outside portion of said bottom cover and facing outwardly from said bottom cover whereby, in an open position of said cosmetic container, a person using said cosmetic container may view said magnifying mirror while applying cosmetics to one's face and said cosmetic container may be oriented by said person while held in said person's hand such that said person may view the plain mirror on said bottom cover while said cosmetic container is in a closed position of said top cover with respect to said bottom cover.

* * * * *